US009321262B2

(12) United States Patent
Takahashi et al.

(10) Patent No.: US 9,321,262 B2
(45) Date of Patent: Apr. 26, 2016

(54) LIQUID DISCHARGE HEAD AND METHOD FOR MANUFACTURING THE SAME

(71) Applicant: CANON KABUSHIKI KAISHA, Tokyo (JP)

(72) Inventors: Tomohiro Takahashi, Yokohama (JP); Takeshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/242,514

(22) Filed: Apr. 1, 2014

(65) Prior Publication Data

US 2014/0300667 A1 Oct. 9, 2014

(30) Foreign Application Priority Data

Apr. 4, 2013 (JP) ..... 2013-078321

(51) Int. Cl.
*B41J 2/14* (2006.01)

(52) U.S. Cl.
CPC .... *B41J 2/14072* (2013.01); *B41J 2002/14491* (2013.01)

(58) Field of Classification Search
None
See application file for complete search history.

(56) References Cited

U.S. PATENT DOCUMENTS

2005/0275695 A1* 12/2005 Murata ..... 347/70

FOREIGN PATENT DOCUMENTS

JP 10-340923 A 12/1998

* cited by examiner

*Primary Examiner* — Justin Seo
(74) *Attorney, Agent, or Firm* — Canon USA Inc. IP Division

(57) ABSTRACT

A liquid discharge head includes a recording element substrate comprising a semiconductor substrate having an pressure generating element configured to generate pressure for discharging liquid, on a first surface, a flow path forming member disposed on the first surface, and in which a discharge port configured to discharge the liquid and a liquid flow path in communication with the discharge port are formed, and a connection terminal disposed in a vicinity of an end portion of the first surface, and an electric wiring substrate electrically connected to the connection terminal. The recording element substrate includes an insulating resin layer disposed in a vicinity of the end portion of the first surface and outward from the connection terminal, and an adhesiveness improving layer disposed between the insulating resin layer and the semiconductor substrate, and configured to improve adhesiveness between the insulating resin layer and the semiconductor substrate.

7 Claims, 8 Drawing Sheets

LIQUID DISCHARGE HEAD AND METHOD FOR MANUFACTURING THE SAME

BACKGROUND OF THE INVENTION

1. Field of the Invention

The present invention relates to a liquid discharge head that discharges liquid, and an inkjet recording head that discharges ink.

2. Description of the Related Art

Wire bonding and inner lead bonding (ILB) are available as a method for electrically connecting a semiconductor chip (also referred to as a recording element substrate) and an electric wiring substrate that are mounted on an inkjet recording head. For example, the wire bonding is a method of electrically connecting a pad disposed on the semiconductor chip with a lead disposed on the electric wiring substrate via a metal wire. When the electrical connection is achieved by the wire bonding, an edge touch short circuit might occur. Specifically, the wire might touch an edge portion of the semiconductor chip to cause a short circuit. As a configuration for preventing the edge touch, the wire may have a higher loop height so as to increase the distance between the wire and the semiconductor chip edge portion.

In the inkjet recording head, a discharge port that discharges ink is disposed on a surface layer of the semiconductor chip. The distance between a nozzle and a print sheet has been required to be shorter to improve image quality of a print product. To shorten the distance between the discharge port of the semiconductor chip and the print sheet, the size of the portion of a connection line loop protruded from the semiconductor chip surface needs to be smaller. In other words, the height of the connection line loop needs to be lowered.

All things considered, there has been required a method for securing insulation between the connection line and the semiconductor chip, without increasing the height of the connection line loop, and desirably with the height of the connection line loop being lower than that in a conventional case.

Japanese Patent Application Laid-Open No. 10-340923 discusses a method to address this problem. Specifically, a semiconductor chip is obtained by forming an insulating film such as a resin on a semiconductor substrate such as a wafer before it is cut, and cutting the semiconductor substrate together with the insulating film. Thus, an end portion (edge portion) of the surface of the semiconductor substrate is protected by the insulating film.

SUMMARY OF THE INVENTION

According to an aspect of the present invention, a liquid discharge head includes a recording element substrate comprising a semiconductor substrate having a pressure generating element configured to generate pressure for discharging liquid, on a first surface, a flow path forming member disposed on the first surface of the semiconductor substrate, and in which a discharge port configured to discharge the liquid and a liquid flow path in communication with the discharge port are formed, and a connection terminal disposed in a vicinity of an end portion of the first surface of the semiconductor substrate, and an electric wiring substrate electrically connected to the connection terminal. The recording element substrate includes an insulating resin layer disposed in a vicinity of the end portion of the first surface and outward from the connection terminal, and an adhesiveness improving layer disposed between the insulating resin layer and the semiconductor substrate, and configured to improve adhesiveness between the insulating resin layer and the semiconductor substrate.

According to another aspect of the present invention, a recording element substrate includes a semiconductor substrate comprising a pressure generating element configured to generate pressure for discharging liquid, on a first surface, a flow path forming member disposed on the first surface of the semiconductor substrate, and in which a discharge port configured to discharge the liquid and a liquid flow path in communication with the discharge port are formed, and a connection terminal disposed in a vicinity of an end portion of the first surface of the semiconductor substrate. In the recording element substrate, an insulating resin layer is disposed in a vicinity of the end portion of the first surface and outward from the connection terminal, and an adhesiveness improving layer configured to improve adhesiveness between the insulating resin layer and the semiconductor substrate is disposed between the insulating resin layer and the semiconductor substrate.

According to yet another aspect of the present invention, a method for manufacturing a plurality of the recording element substrates, by cutting a semiconductor substrate comprising the pressure generating element on the first surface includes (1) forming on the semiconductor substrate the adhesiveness improving layer being set apart from a cut position of the semiconductor substrate, (2) forming the insulating resin layer on the adhesiveness improving layer and on the semiconductor substrate, and (3) cutting the semiconductor substrate and the insulating resin layer.

Further features of the present invention will become apparent from the following description of exemplary embodiments with reference to the attached drawings.

DESCRIPTION OF THE EMBODIMENTS

Adhesiveness between a semiconductor substrate and an insulating film is not sufficiently achieved by the method discussed in Japanese Patent Application Laid-Open No. 10-340923. Thus, when the semiconductor substrate is cut together with the insulating film, a part of the insulating film on a surface end portion (edge portion) of the semiconductor substrate might be peeled or chipped off. As a result, the semiconductor substrate is exposed at the edge portion. Thus, a connection line might come into direct contact with the edge portion to cause a short circuit.

Thus, the present invention is directed to a liquid discharge head, in which an insulating resin layer on the edge portion is less likely to be peeled or chipped off when the semiconductor substrate is cut, and the insulation between the connection line and the semiconductor substrate is secured.

The liquid discharge head can be mounted on an apparatus such as a printer, a copying machine, a facsimile including a communication system, and a word processor including a printer unit, or an industrial recording apparatus combined with various processing devices in a complex manner. The liquid discharge head can be used for recording an image on various recording media such as paper, thread, fiber, leather, metal, plastic, glass, wood, and ceramics. The term "recording" used herein means to provide not only a meaningful image such as a character or graphics but also a meaningless image such as a pattern to a recording medium. The term "liquid" used herein is widely construed as liquid used for forming an image, a design, or a pattern on a recording medium, or processing ink or a recording medium. The processing of ink or a recording medium means, for example, improvement of fixability by coagulation and insolubilization of a color material in ink added to the recording medium, improvement of recording quality or a color property, or improvement of image durability.

The description will be given below with an ink jet recording head as an example of the liquid discharge head to which an exemplary embodiment of the present invention is applied. However, the scope of application of the present invention is not limited to this. The liquid discharge head is not limited to the inkjet recording head. An exemplary embodiment of the present invention can be applied to a method for manufacturing a liquid discharge head used for producing a biochip or for electronic circuit printing. Alternatively, an exemplary embodiment of the present invention may also be applied to a liquid discharge head for manufacturing a color filter, for example.

Figure 11:
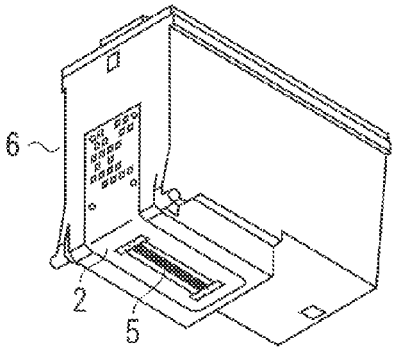
FIG. 11 is a schematic perspective view illustrating a configuration example of a liquid discharge head.

FIG. 11 is a view illustrating a configuration example of a liquid discharge head manufactured according to an exemplary embodiment of the present invention. A liquid discharge head 6 includes a recording element substrate 5 and an electric wiring substrate 2. The liquid discharge head 6 may further include an ink accommodating unit. Ink is injected and stored in the ink accommodating unit. The ink is guided to the recording element substrate 5 through an ink supply flow path in communication with the ink accommodating unit. The ink is discharged through a discharge port 84 formed in the recording element substrate 5. The liquid discharge head 6 and the ink accommodating unit may be integrally formed, or the ink accommodating unit may be removably attached to the liquid discharge head 6.

An ink supply port formed of a through-hole is provided in a semiconductor substrate 1 of the recording element substrate 5, and is in communication with the ink supply flow path. Pressure generating elements 81 that generate pressure to be utilized for discharging ink are formed along both sides of an opening on a first surface side of the ink supply port. A line for supplying power and an electrical signal to the pressure generating element 81 is formed in the semiconductor substrate 1. A plurality of connection terminals (also referred to as connection pads) 21 is disposed around an end portion of the semiconductor substrate 1 of the recording element substrate 5. The connection terminal receives an electrical signal and power from the electric wiring substrate 2. The discharge ports 84 corresponding to the pressure generating elements 81 are formed in a flow path forming member 85 disposed on the semiconductor substrate 1. A liquid flow path 83 that communicates the discharge port 84 with the ink supply port is formed between the flow path forming member 85 and the semiconductor substrate 1.

The electric wiring substrate 2 is a wiring member that transmits an electrical signal and power for discharging ink, from a recording device main body to the recording element substrate 5. On the electric wiring substrate 2, a contact portion, an electrical wire sandwiched by resin films, and a lead line exposed from an end surface of the resin films are formed, for example. An example of such an electric wiring substrate 2 includes a flexible printed circuit (FPC) and a tape for use in tape automated bonding (TAB). The contact portion includes a plurality of contact pads, and comes into contact and thus is electrically connected with a connector pin on the recording device main body side when the liquid discharge head 6 is mounted to the recording device main body. The electric wiring on the electric wiring substrate 2 connects the contact portion with the lead line. The lead line is electrically connected to the contact terminal disposed at the edge of the recording element substrate 5. After the lead line is connected to the connection terminal of the recording element substrate 5, a sealing portion may be formed by using a sealing agent made of resin material. The sealing portion covers and protects the electrically connected portion including the connection terminals from liquid such as ink.

The recording element substrate 5 can be bonded to a supporting substrate 3 as a part of a casing of the liquid discharge head 6 by applying an adhesive on the supporting substrate 3 and aligning the recording element substrate 5.

Various exemplary embodiments, features, and aspects of the invention will be described in detail below with reference to the drawings.

Figure 1A:
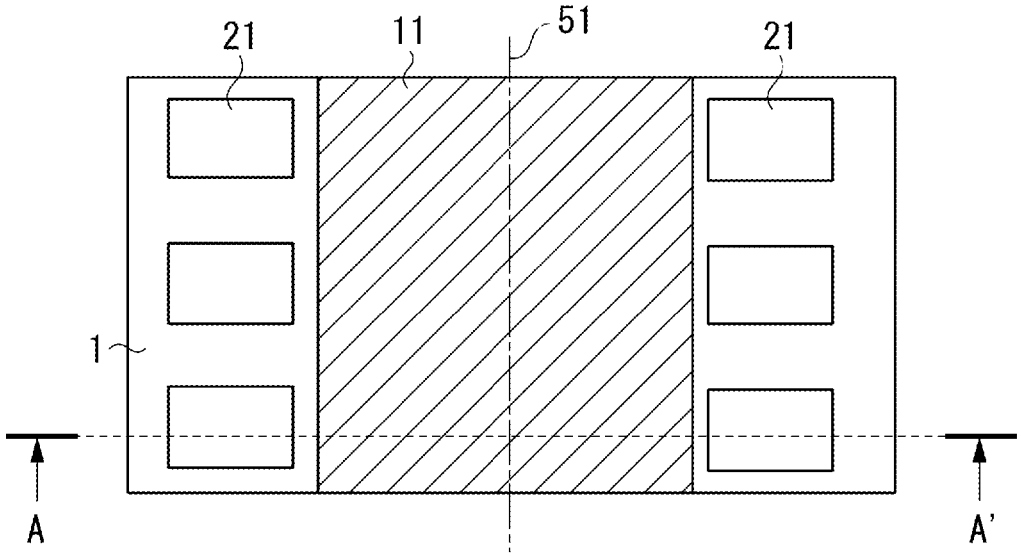
FIGS. 1A and 1B are respectively a schematic top view and a schematic cross-sectional view illustrating a state before a cutting step in a manufacturing method according to an exemplary embodiment.
Figure 1B:
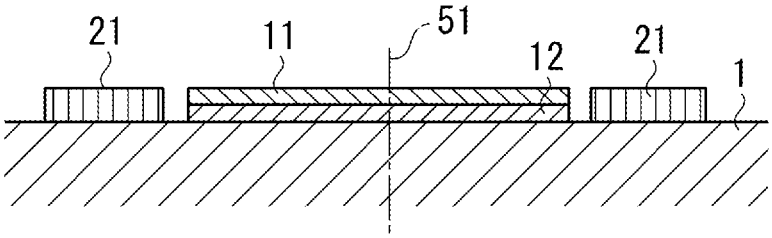

FIG. 1A is a schematic plan view illustrating a configuration example of a semiconductor substrate before it is cut. FIG. 1B is a cross-sectional view of FIG. 1A, taken along a line A-A'. In FIGS. 1A and 1B, the connection pads (connection terminals) 21 are formed on a surface (also referred to as a first surface) of a semiconductor substrate 1 such as a wafer substrate. In FIGS. 1A and 1B, the connection pads 21 are arranged in a row on both sides across a cut position 51 of the semiconductor substrate 1. An insulating resin layer 11 is disposed between the connection pads 21. The insulating resin layer 11 is disposed on the semiconductor substrate 1 with an adhesiveness improving layer 12 interposed therebetween. The adhesiveness improving layer 12 improves the adhesiveness between the insulating resin layer 11 and the semiconductor substrate 1. In other words, the adhesiveness improving layer 12 is disposed on the semiconductor substrate 1 and the insulating resin layer 11 is disposed on the adhesiveness improving layer 12.

For example, a polyether amide resin is used for the adhesiveness improving layer 12. The polyether amide resin is obtained by, for example, polycondensing a dichloride of terephthalic acid, isophthalic acid, oxydibenzoic acid, biphenyldicarboxylic acid or naphthalenedicarboxylic acid with a diamine such as 2,2-bis{4-(4-aminophenoxy) phenyl}propane or 2,2-bis{3-methyl-4-(4-aminophenoxy) phenyl}propane. To improve heat resistance, resins obtained by adding, as another component than the above components, diamines such as 4,4'-diaminodiphenylmethane or 3,3'-diaminodiphenylsulfone and conducting polycondensation may be used.

The thickness of the adhesiveness improving layer 12 can be equal to or larger than 0.5 μm and is equal to or smaller than 5 μm. When the thickness is equal to or larger than 0.5 μm, the function of improving the adhesiveness can be effectively exerted. When the thickness is equal to or smaller than 5 μm, the damage to a cutting blade 71 can be effectively reduced.

Figure 2:
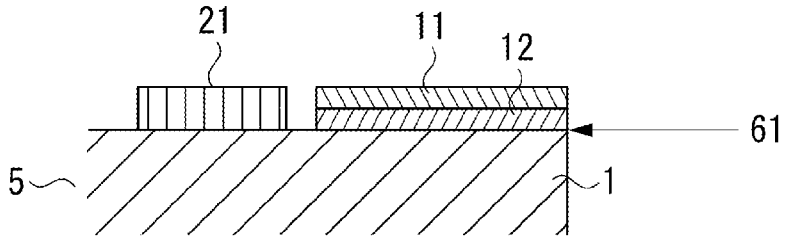
FIG. 2 is a schematic cross-sectional view illustrating a state after the cutting step in the manufacturing method according to an exemplary embodiment.

The semiconductor substrate 1 is cut along the cut position 51 placed between the connection pads 21. FIG. 2 is a schematic cross-sectional view of the semiconductor chip (recording element substrate) 5 obtained by cutting the semiconductor substrate 1.

In FIG. 2, the connection pad 21 is disposed on the semiconductor substrate surface in the vicinity of an end portion thereof, for the connection with the electric wiring substrate 2. The insulating resin layer 11 is disposed on the semiconductor substrate surface in the vicinity of the end portion thereof, and outward from the connection terminal 21. More specifically, the insulating resin layer 11 is disposed from the end portion (edge portion) of the semiconductor substrate surface. The insulating resin layer 11 may cover a side surface of the semiconductor substrate 1. The adhesiveness improving layer 12 that improves the adhesiveness between the insulating resin layer 11 and the semiconductor substrate 1 is disposed between the insulating resin layer 11 and the semiconductor substrate 1.

Here, for example, when the insulating resin layer 11 is disposed on the substrate 1 without the adhesiveness improving layer 12 interposed therebetween, and the cutting is performed with a dicing blade, a part of the insulating resin layer 11 is likely to be peeled or chipped off from the semiconductor substrate 1. This is caused by the impact produced when the blade rotating at high speed touches the insulating resin layer 11. Thus, in the configuration of the present exemplary embodiment, the insulating resin layer 11 is disposed on the semiconductor substrate 1 with the adhesiveness improving layer 12 interposed therebetween. As a result, the adhesiveness between the insulating resin layer 11 and the semiconductor substrate 1 is improved, whereby the insulating resin layer 11 is less likely to be peeled or chipped off from the semiconductor substrate 1 after the semiconductor substrate 1 is cut.

Figure 3:
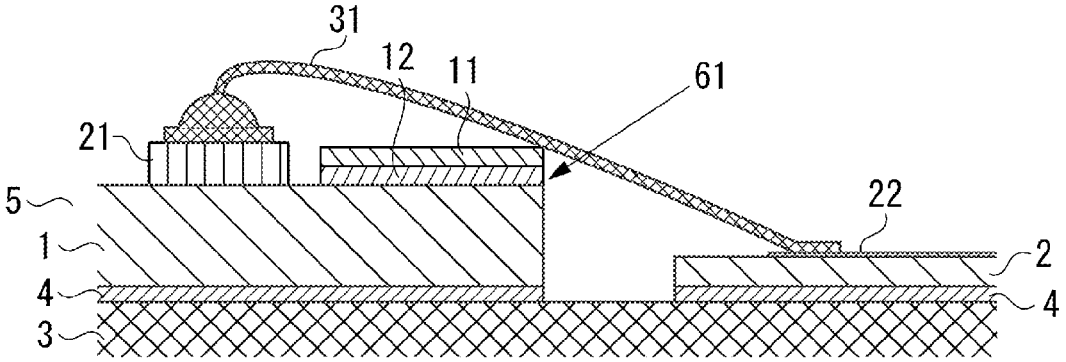
FIG. 3 is a schematic cross-sectional view illustrating a configuration example of a liquid discharge head according to an exemplary embodiment.

Then, as shown in FIG. 3, the recording element substrate (semiconductor chip) 5 obtained by cutting the semiconductor substrate 1 and the electric wiring substrate 2 are disposed on the supporting substrate 3 via an adhesive 4. The connection pad 21 of the semiconductor chip 5 and a lead 22 disposed on the electric wiring substrate 2 are electrically connected with each other by wire bonding, ILB, or the like. FIG. 3 illustrates a state where the electrical connection is achieved by the wire bonding using a connection line 31 such as a gold wire. An edge portion 61 being a surface end portion of the semiconductor substrate 1 is positioned between the connection pad 21 and the lead 22. The edge portion 61 of the semiconductor substrate is protected by the insulating resin layer 11 disposed on the semiconductor substrate 1 with the adhesiveness improving layer 12 interposed therebetween. Thus, the insulation between the recording element substrate 5 and the connection line 31 is secured. In the present exemplary embodiment, the connection line 31 includes a wire, an inner lead, and like.

Figure 6:
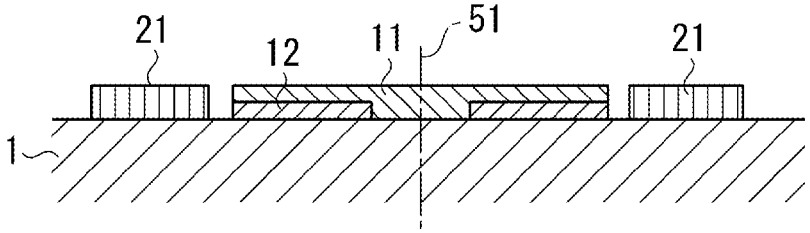
FIG. 6 is a schematic cross-sectional view illustrating a state before the cutting step in the manufacturing method according to an exemplary embodiment.

In the exemplary embodiment described thus far, the adhesiveness improving layer 12 is assumed to be cut when the semiconductor substrate 1 is cut. Here, if chippings include the chipping of the adhesiveness improving layer 12, the chipping might be more likely to adhere to a flow path forming member surface and the insulating resin layer 11. Thus, a washing condition harder than that for general washing for the flow path forming member surface might be required to remove such chippings from the flow path forming member surface. However, the harder washing condition might not be able to be employed considering the damage to the flow path forming member surface. Thus, as illustrated in FIG. 6, the adhesiveness improving layer 12 disposed on the substrate 1 may be set apart (hereinafter referred to as "offset") from the cut position 51. The adhesiveness improving layer 12 is offset from the cut position 51 so as not to touch the cutting blade 71, whereby the chippings include no chipping of the adhesiveness improving layer 12. Thus, the chippings are less likely to adhere to the flow path forming member surface. As a result, the chippings can be removed from the flow path forming member surface under the normal washing condition.

Figure 8:
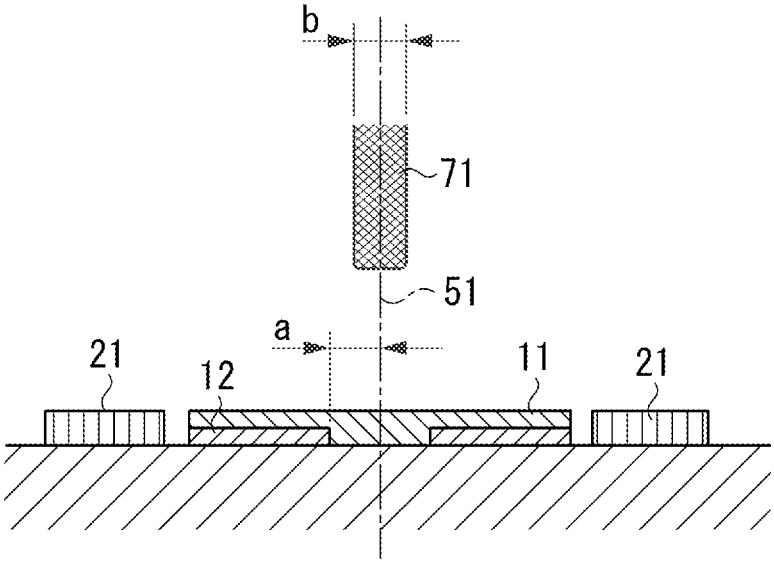
FIG. 8 is a schematic cross-sectional view illustrating dimensional relationship of an offset amount of an adhesiveness improving layer according to an exemplary embodiment.

In the present exemplary embodiment, an offset amount required for the adhesiveness improving layer 12 not to touch the cutting blade 71 when the semiconductor substrate 1 is cut will be described with reference to FIG. 8. An offset amount (a) of the adhesiveness improving layer 12 is determined such that the adhesiveness improving layer 12 is prevented from touching the cutting blade 71, based on a thickness (b) of the cutting blade 71 and a positional accuracy (±c) of the cutting. In this specification, the offset amount (a) is a distance between the center of the cut position 51 and an end portion of the adhesiveness improving layer 12. The adhesiveness improving layer 12 does not touch the cutting blade 71 when the following Formula 1 is satisfied:

$$a>b/2+c \quad (1).$$

If the offset amount (a) of the adhesiveness improving layer 12 is too large, the distance between the edge portion 61 and the end portion of the adhesiveness improving layer 12 is long. Thus, the portion of the insulating resin layer 11 disposed on the semiconductor substrate 1 with no adhesiveness improving layer 12 interposed therebetween is wide. As a result, the insulating resin layer 11 might be peeled or chipped off when the semiconductor substrate 1 is cut. Thus, the offset amount (a) of the adhesiveness improving layer 12 is a smallest possible value satisfying Formula (1), and can be in the range described in the following Formula (2):

$$b/2+c<a<b/2+c+20\ \mu m \quad (2).$$

For example, when the thickness (b) of the cutting blade 71 is 60 μm, and the cut positional accuracy (c) is ±10 μm, the offset amount (a) of the adhesiveness improving layer 12 from the cut position 51 can be 40 to 60 μm, based on Formula (2).

Figure 7:
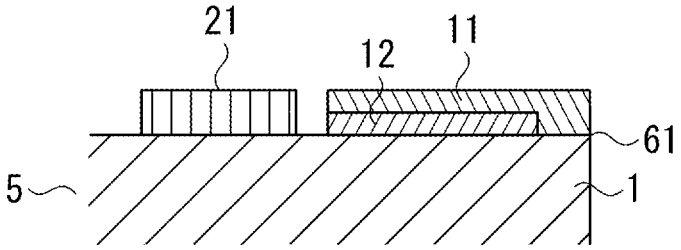
FIG. 7 is a schematic cross-sectional view illustrating a state after the cutting step in the manufacturing method according to an exemplary embodiment.

FIG. 7 is a schematic cross-sectional view of the recording element substrate (semiconductor chip) 5 obtained by cutting the semiconductor substrate 1. In FIG. 7, the insulating resin layer 11 is disposed from the surface end portion. The connection terminal 21 is disposed in the vicinity of the surface end portion. The adhesiveness improving layer 12 is disposed away from the surface end portion.

A method for manufacturing an inkjet recording head according to a first exemplary embodiment is described with reference to FIGS. 4A, 4B, 4C, 4D, 4E, 4F, and 5. The present invention is not limited to the exemplary embodiments described below. In the present exemplary embodiment, a single semiconductor substrate of a wafer substrate is cut to produce a plurality of recording element substrates 5.

Figure 4A:
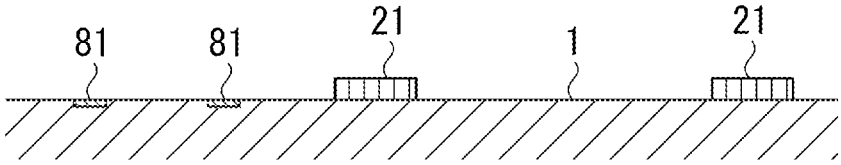
FIGS. 4A, 4B, 4C, 4D, 4E, and 4F are schematic cross-sectional step views each illustrating a manufacturing step for a recording element substrate according to a first exemplary embodiment.

In FIG. 4A, the pressure generating elements are formed on a first surface of the semiconductor substrate 1. The connection pads 21 are formed on the first surface of the semiconductor substrate 1.

In the present exemplary embodiment, an ink-resistant photosensitive resin is used as the insulating resin layer 11. The photosensitive resin is used as the flow path forming member 85 of the inkjet recording head. As the adhesiveness improving layer 12, a polyether amide resin (HIMAL 122, manufactured by Hitachi Chemical Co., Ltd. N-methylpyrrolidone/butyl cellosolve acetate solvent) is used. The polyether amide resin is used as an intermediate layer 13, which improves adhesiveness between the flow path forming member 85 and the semiconductor substrate 1. Thus, in the present exemplary embodiment, the intermediate layer 13 and the adhesiveness improving layer 12 are formed of the same material and are simultaneously formed. The flow path forming member 85 and the insulating resin layer 11 are formed of the same material and are simultaneously formed.

Figure 4B:
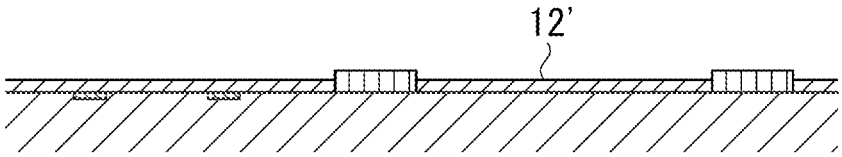

As illustrated in FIG. 4B, a polyether amide resin 12' as a material of the intermediate layer 13 and the adhesiveness improving layer 12 is applied in the thickness of 2 μm on the first surface of the semiconductor substrate 1 by spin coating and is baked to be cured.

Figure 4C:
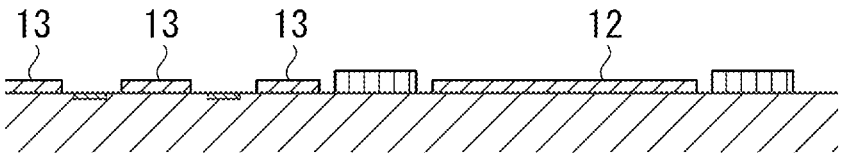

Next, as shown in FIG. 4C, a positive resist is patterned on the polyether amide resin 12'. Then, the polyether amide resin 12' is patterned by plasma ashing, and thus the adhesiveness improving layer 12 and the intermediate layers 13 are formed. When the polyether amide resin 12' is patterned, the resin at an unnecessary portion such as portions around the pressure generating elements 81 is removed. Then, the positive resist used for the patterning is removed.

Figure 4D:
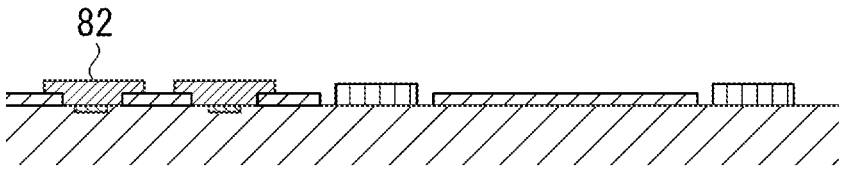

Next, a mold pattern 82 for the liquid flow path 83 formed of a positive resist is formed as illustrated in FIG. 4D.

A material used for the mold pattern 82 can be any material that can be dissolved and removed in a later step, and is desirably a positive resist.

Figure 4E:
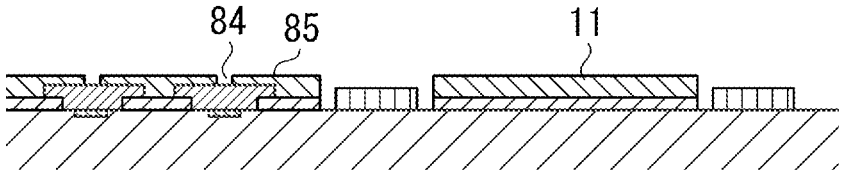

Next, as shown in FIG. 4E, the photosensitive resin is applied by spin coating. Then, patterning is performed to remove the photosensitive resin at the portions where no photosensitive resin is required, such as portions at the discharge ports 84 and around the connection pads 21. Thus, the insulating resin layer 11 and the flow path forming member 85 are formed. The thickness of the photosensitive resin layer, that is, the insulating resin layer 11, is 20 μm.

A negative photosensitive resin or a positive photosensitive resin may be used as the photosensitive resin for example. The negative photosensitive resin is desirably used.

Figure 4F:
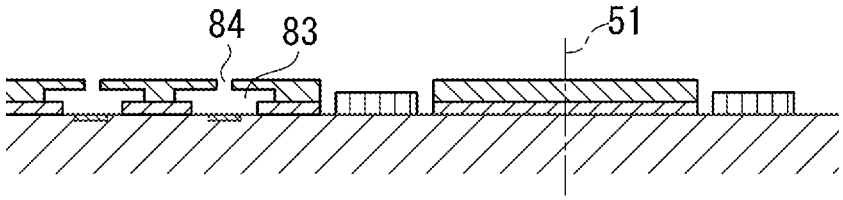
Figure 5:
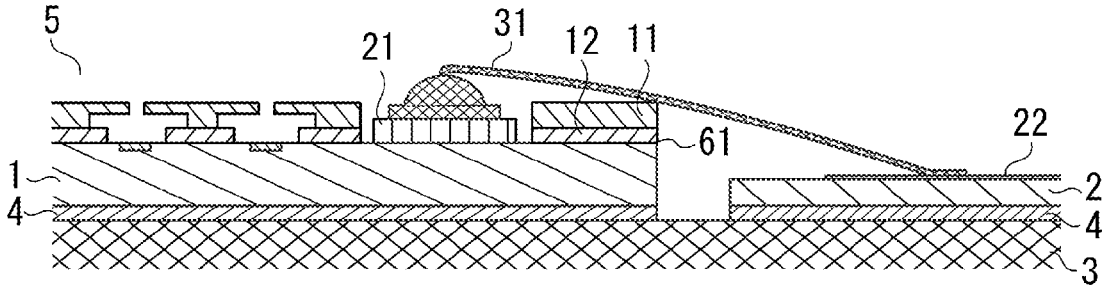
FIG. 5 is a schematic cross-sectional view illustrating a configuration of a liquid discharge head after the recording element substrate and an electric wiring substrate are electrically connected with each other according to the first exemplary embodiment.

Next, as illustrated in FIG. 4F, the mold pattern 82 is removed, and thus the ink flow path (liquid flow path) 83 is formed.

Next, the semiconductor substrate 1 is cut by the dicing blade along the cut position 51 provided at the center between the connection pads 21. Thus, the recording element substrate (semiconductor chip) 5 is obtained, in which the flow path forming member 85 having the discharge ports 84 is formed.

Next, the recording element substrate 5 obtained and the electric wiring substrate 2 are disposed on the supporting substrate 3 via the adhesive 4. Then, the connection pad 21 and the electric substrate lead 22 of the recording element substrate 5 are electrically connected with each other via the connection line 31 made of gold (see FIG. 5).

In the recording element substrate 5 obtained, the insulating resin layer 11 is disposed on the semiconductor substrate 1 with the adhesiveness improving layer 12 interposed therebetween. Thus, the insulating resin layer 11 is less likely to be peeled or chipped off after the semiconductor substrate 1 is cut, and the edge portion 61 of the chip is protected by the insulating resin layer 11. Thus, the insulation between the connection line 31 and the semiconductor substrate 1 is secured in the inkjet recording head obtained.

In the present exemplary embodiment, the method for manufacturing the inkjet recording head (FIG. 11) may be completed after a step of filling ink and other steps.

Figure 9A:
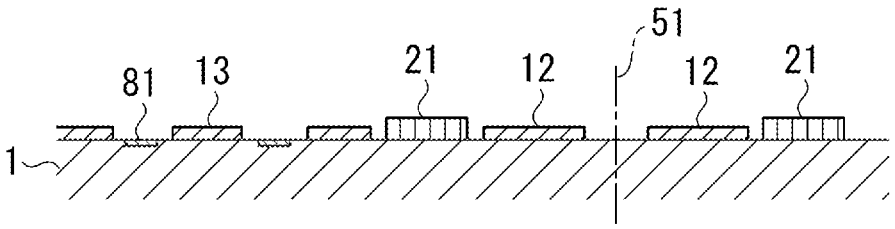
FIGS. 9A and 9B are schematic cross-sectional views each illustrating a manufacturing step for a recording element substrate according to a second exemplary embodiment.
Figure 9B:
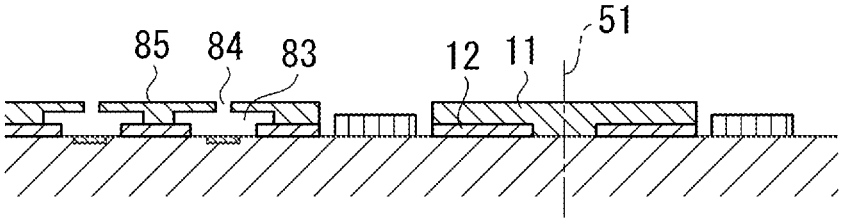
Figure 10:
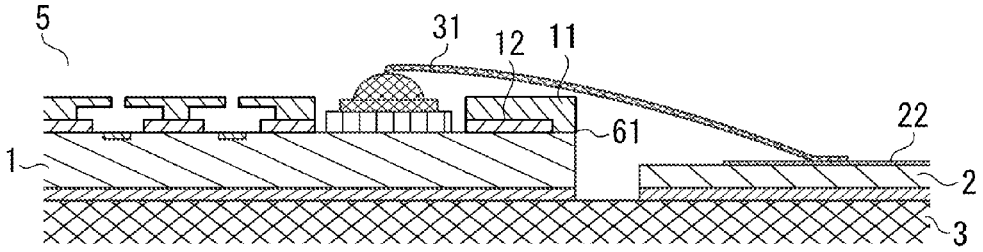
FIG. 10 is a schematic cross-sectional view illustrating a configuration of a liquid discharge head after the recording element substrate and an electric wiring substrate are electrically connected with each other according to the second exemplary embodiment.

A method for manufacturing an inkjet recording head according to a second exemplary embodiment is described with reference to FIGS. 9A, 9B, and 10. Matters not particularly described herein are similar to the counterparts in the first exemplary embodiment.

In the present exemplary embodiment, the thickness (b) of the cutting blade 71 used is 50 μm, and the cut positional accuracy (c) is ±10 μm. Thus, from Formula (2), a desirable offset amount (a) of the adhesiveness improving layer 12 to prevent the adhesiveness improving layer 12 from touching the cutting blade 71 is calculated to be 35 to 55 μm. In the present exemplary embodiment, the offset amount (a) of the adhesiveness improving layer 12 is 50 μm.

The polyether amide resin 12' is applied on the semiconductor substrate 1 by spin coating, and baked to be cured. Then, the positive resist is patterned on the polyether amide resin 12', and then pattering by plasma ashing is performed to form the adhesiveness improving layer 12. The polyether amide resin 12' is patterned such that the offset amount (a) of the adhesiveness improving layer 12 becomes 50 μm (see FIG. 9A). Then, as in the first exemplary embodiment, the photosensitive resin is applied and the pattering is performed. Thus, the flow path forming member 85 having the discharge ports 84 is formed. At the same time, the insulating resin layer 11 made of the same material as the flow path forming member 85 is formed at a portion in the vicinity of the cutting portion 51 (see FIG. 9B). Next, the semiconductor substrate 1 is cut along the cut position 51. Then, the recording element substrate (semiconductor chip) 5 obtained and the electric wiring substrate 2 are disposed on the supporting substrate 3, and are electrically connected with each other by the wire bonding (see FIG. 10). A step of filling ink may be performed thereafter.

In the present exemplary embodiment, the insulating resin layer 12 is not peeled when the semiconductor substrate 1 is cut, and the edge portion 61 of the chip is protected by the insulating resin layer 11. Thus, the insulation between the connection line 31 and the semiconductor substrate 1 is secured.

The adhesiveness improving layer 12 does not touch the cutting blade 71 when the cutting is performed. Thus, the chippings include no chipping of the adhesiveness improving layer 12. Thus, the chippings are less likely to adhere to the flow path forming member surface. As a result, the chippings can be removed from the flow path forming member surface under the normal washing condition.

According to an exemplary embodiment of the present invention, the adhesiveness between the semiconductor substrate and the insulating resin layer is improved. Thus, the insulating resin layer on the edge portion is less likely to be peeled or chipped off when the semiconductor substrate is cut. As a result, the edge portion is protected by the insulating resin layer, and thus insulation between the connection line and the semiconductor substrate is secured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-078321 filed Apr. 4, 2013, which is hereby incorporated by reference herein in its entirety.

What is claimed is:

1. A liquid discharge head comprising:

a recording element substrate comprising:

a semiconductor substrate having a pressure generating element configured to generate pressure for discharging liquid;

a flow path forming member forming a discharge port configured to discharge the liquid and a liquid flow path in communication with the discharge port; and a connection terminal disposed on a first surface of the semiconductor substrate and in a vicinity of an end portion of the semiconductor substrate; and an electric wiring substrate electrically connected to the connection terminal via a connection line;

a supporting substrate supporting a surface opposite to the first surface of the semiconductor substrate, and the electric wiring substrate, wherein the recording element substrate includes an insulating resin layer and an adhesiveness improving layer, the insulating resin layer is disposed on a side of the first surface of the semiconductor substrate, closer to the end portion than the connection terminal, and between the semiconductor substrate and the connection line, and the adhesiveness improving layer is disposed between the insulating resin layer and the semiconductor substrate, and configured to improve adhesiveness between the insulating resin layer and the semiconductor substrate.

2. The liquid discharge head according to claim 1, further comprising an intermediate layer disposed between the flow path forming member and the semiconductor substrate, and configured to improve adhesiveness between the flow path forming member and the semiconductor substrate, wherein the flow path forming member is disposed on the first surface, wherein the adhesiveness improving layer and the intermediate layer are made of a same material, and wherein the insulating resin layer and the flow path forming member are made of a same material.

3. The liquid discharge head according to claim 1, wherein the adhesiveness improving layer is formed of a polyether amide resin.

4. The liquid discharge head according to claim 1, wherein the insulating resin layer is disposed on a region including the end portion, and wherein the adhesiveness improving layer is disposed away from the end portion.

5. A method for manufacturing a plurality of recording element substrates each including a connection terminal disposed on a first surface of a semiconductor substrate in a vicinity of a cut position of the semiconductor substrate, by cutting the semiconductor substrate comprising a pressure generating element configured to generate pressure for discharging liquid, the method comprising:

(1) forming an adhesiveness improving layer on the first surface of the semiconductor substrate, the adhesiveness improving layer being set apart from the cut position of the semiconductor substrate and being closer to the cut position than the connection terminal;

(2) forming an insulating resin layer on the adhesiveness improving layer and on the first surface; and (3) cutting the semiconductor substrate and the insulating resin layer at the cut position.

6. The method according to claim 5, wherein the recording element substrate includes:

a flow path forming member disposed on the first surface and forming a discharge port configured to discharge the liquid and a liquid flow path in communication with the discharge port, and an intermediate layer between the flow path forming member and the first surface, and wherein the intermediate layer and the adhesiveness improving layer are formed of a same material and formed simultaneously, and the flow path forming member and the insulating resin layer are formed of a same material and formed simultaneously.

7. The liquid discharge head according to claim 1, wherein a thickness of the adhesiveness improving layer is in a range from 0.5 μm to 5 μm.

* * * * *